US008014713B2

(12) United States Patent
Yamada et al.

(10) Patent No.: US 8,014,713 B2
(45) Date of Patent: Sep. 6, 2011

(54) FIXING DEVICE AND IMAGE FORMING APPARATUS

(75) Inventors: Shintaroh Yamada, Kawasaki (JP); Hidehiko Fujiwara, Tokyo (JP); Kazunori Bannai, Atsugi (JP); Manabu Nonaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 183 days.

(21) Appl. No.: 12/314,400

(22) Filed: Dec. 10, 2008

(65) Prior Publication Data

US 2009/0148207 A1 Jun. 11, 2009

(30) Foreign Application Priority Data

Dec. 11, 2007 (JP) ..... 2007-320037

(51) Int. Cl.
*G03G 15/20* (2006.01)

(52) U.S. Cl. ..... 399/331; 399/122

(58) Field of Classification Search ..... 399/122, 399/331, 329
See application file for complete search history.

(56) References Cited

U.S. PATENT DOCUMENTS

| | | | | |
|---|---|---|---|---|
| 6,151,466 | A | 11/2000 | Fujiwara | |
| 6,195,525 | B1 * | 2/2001 | Maeyama | 399/328 |
| 6,542,712 | B2 | 4/2003 | Kamijo et al. | |
| 6,564,033 | B2 | 5/2003 | Zhou et al. | |
| 6,731,900 | B2 | 5/2004 | Takenaka et al. | |
| 6,731,902 | B2 | 5/2004 | Takenaka et al. | |
| 6,788,916 | B2 | 9/2004 | Takenaka et al. | |
| 6,801,744 | B2 | 10/2004 | Fujiwara et al. | |
| 6,907,218 | B2 | 6/2005 | Fujiwara et al. | |
| 7,013,108 | B2 | 3/2006 | Takenaka et al. | |
| 7,242,896 | B2 | 7/2007 | Haseba et al. | |
| 2005/0265758 | A1 * | 12/2005 | Haseba et al. | 399/329 |
| 2007/0036572 | A1 * | 2/2007 | Ide et al. | 399/69 |
| 2008/0003027 | A1 * | 1/2008 | Su | 399/329 |
| 2008/0124152 | A1 | 5/2008 | Nishikawa et al. | |

FOREIGN PATENT DOCUMENTS

| | | |
|---|---|---|
| CN | 1363861 | 8/2002 |
| CN | 1704854 | 12/2005 |
| JP | 5-053461 | 3/1993 |
| JP | 11-133800 | 5/1999 |
| JP | 2000-162907 | 6/2000 |
| JP | 2000-235325 | 8/2000 |
| JP | 2002-006656 | 1/2002 |
| JP | 2007-206389 | 8/2007 |

OTHER PUBLICATIONS

Chinese Office Action dated Apr. 28, 2010 and English translation thereof.

* cited by examiner

*Primary Examiner* — Constantine Hannaher
(74) *Attorney, Agent, or Firm* — Harness, Dickey & Pierce, P.L.C.

(57) ABSTRACT

A fixing device includes a flexible fixing member that heats a toner image to fuse, a contact member fixedly disposed internal to the fixing member and comes into contact with a pressure member via the fixing member to form a nip part, a plurality of heating devices that heats the contact member, wherein the contact member always maintains the contact state with the pressure member via the fixing member, the plurality of heating devices generally remain disposed in the fixing device under an operational state for heating and are freely removable for replacement under a non-operational state for heating.

17 Claims, 6 Drawing Sheets

FIXING DEVICE AND IMAGE FORMING APPARATUS

PRIORITY CLAIM

This application claims priority from Japanese Patent Application No. 2007-320037, filed with the Japanese Patent Office on Dec. 11, 2007, the contents of which are incorporated herein by reference in their entirety.

BACKGROUND OF THE INVENTION

1. Field of the Invention

The present invention relates to an image forming apparatus of a copier, a printer, a facsimile or a hybrid machine of these or the like and a fixing device used therefor.

2. Description of Related Art

Conventionally, an on-demand type fixing device with a short rise time is widely known in an image forming apparatus of a copier, a printer or the like (for example, refer to JP2002-6656A).

The on-demand type fixing device is constituted from a fixing film (fixing member such as an endless film), a pressure roller (pressure member), a heater such as a ceramic heater or the like (heating device) and so on. The heater is set up in an internal part of the fixing film, comes into contact with the pressure roller via the fixing film to form a nip part and heats the fixing film. Then a toner image on a recording media delivered towards the nip part receives heat and pressure in the nip part and is fixed to the recording media.

On the other hand, JPH11-133800A, JP2000-162907A and JPH5-53461A disclose a technology that disposes a plurality of heaters (heating device) in an on-demand type fixing device for the purpose of preventing a flaw in which the fixing member heat deteriorates because both end parts of the fixing member have excessive temperature rise when small sized paper is consecutively fed. Specifically, in correspondence to a size in a width direction of a recording media delivered to the nip part, a plurality of heaters are disposed parallel or in line against the width direction so that the area to be heated in the width direction against the fixing film (fixing member) can be set variable.

The heating device such as the heater or the like of the above described conventional on-demand type fixing device has negative replacement property (maintenance property). This is described in detail hereinbelow.

Because the life span of a heater is finite, maintenance and replacement of the heater is performed frequently in the fixing device. However, because the heater is pressure-welded to the pressure roller via the fixing film, it is difficult to pull out the heater applied with pressure directly in the width direction (longitudinal direction).

In order to solve such a flaw, a method of disposing a mechanism that cancels out the pressure between the heater (fixing film) and the pressure roller is also considered. That is, by operating the pressure cancellation mechanism, the heater can be pulled out from the device after the pressure between the heater and the pressure roller is cancelled out. However, in that case, extra cost and space are necessary for the set up of the pressure cancellation mechanism.

In particular, in a conventional on-demand type fixing device, pressure by the pressure member is always applied against the heater. A constitution is adopted in which the heater is easily subject to breakage during jam processing and delivery or the like so that the above described problems cannot be neglected.

In addition, the on-demand type fixing device in the above described JPH11-133800A, JP2000-162907A and JPH5-53461A or the like includes a plurality of heaters disposed so that the above described problems are especially not negligible. In addition, in the case the sizes of a plurality of heaters differ, a nip width of the nip part formed by pressure-welding the heater and the pressure roller becomes non-uniform across the width direction so that fixture irregularities are generated on output images.

SUMMARY OF THE INVENTION

The present invention is made to solve the above described problems. An object of the present invention is to provide a fixing device and an image forming apparatus with short rise time, a relatively simple constitution and a heating device having high replacement property in which fixture irregularity and partial excessive temperature rise of the fixing member are not generated.

To accomplish the above object, the fixing device according to the present invention includes a flexible fixing member that heats a toner image to fuse; a contact member that comes into contact with a pressure member via the fixing member and fixedly disposed in the internal part of the fixing member to form a nip part; a plurality of heating devices that heats the contact member in which the contact member comes into contact with the pressure member via the fixing member. The plurality of heating devices generally remain disposed in the fixing device under an operational state for heating and are freely removable for replacement under a non-operational state for heating.

DETAILED DESCRIPTION OF THE PREFERRED EMBODIMENTS

Preferred embodiments of the present invention will be described in detail with reference to the accompanying drawings hereinbelow. In addition, the same or equal parts in each figure are assigned the same signs. Overlapping descriptions of which are hereby appropriately simplified and abbreviated.

Embodiment 1

A first embodiment of the present invention will be described in detail with reference to FIG. 1 through FIG. 5.

Figure 1:
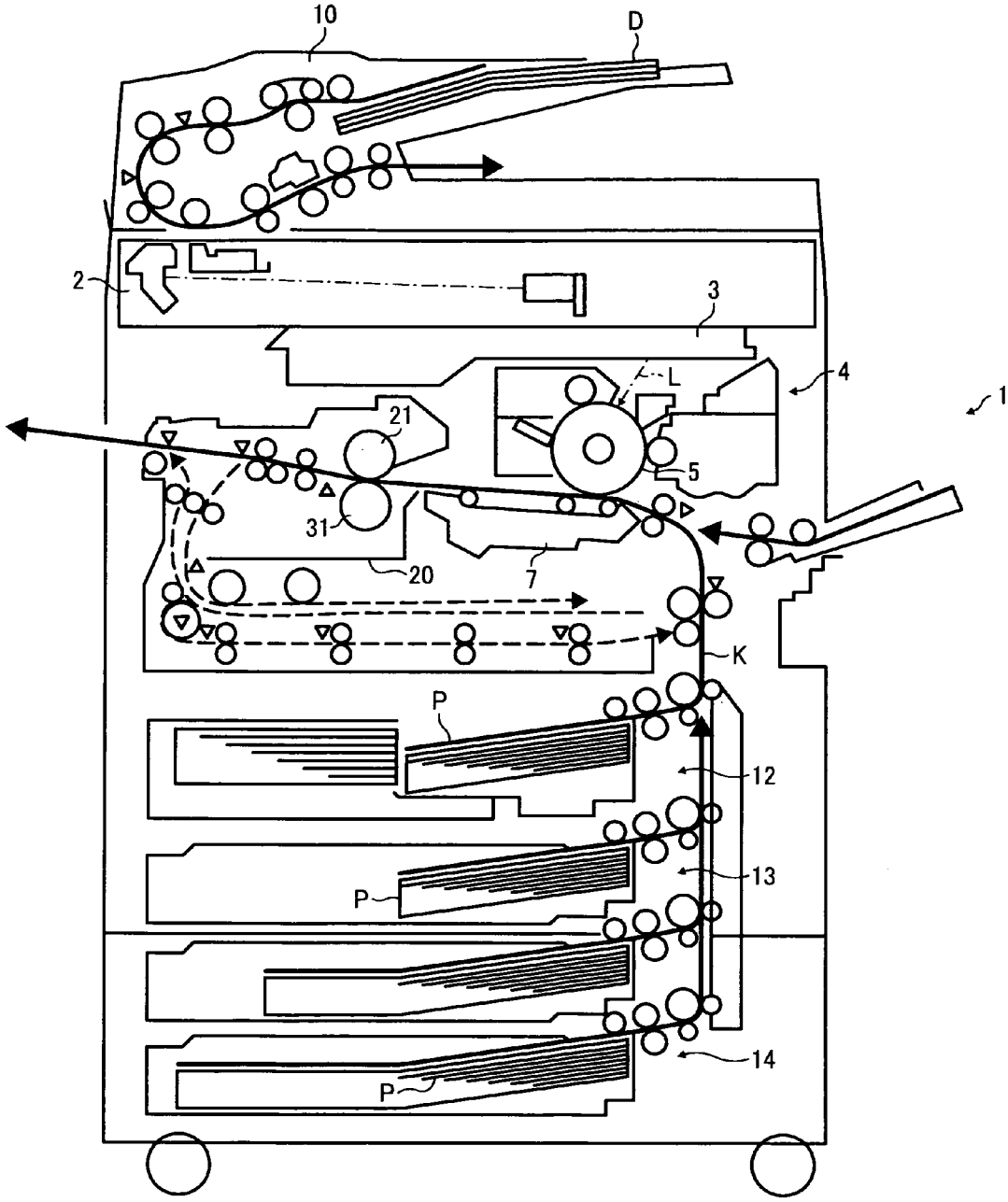
FIG. 1 is a constitutional diagram that illustrates an image forming apparatus in its entirety according to a first embodiment of the present invention.

First, entire constitutions and operations of an image forming apparatus are described in FIG. 1.

In FIG. 1, 1 illustrates an apparatus main body of a copier as an image forming apparatus, 2 a paper read-in part that reads-in optically image information of paper D, 3 an exposure part that irradiates onto a photoconductive drum 5 exposure light L based on image information read-in in the paper read-in part 2, 4 an image forming part that forms a toner image (image) on a photoconductive drum 5, 7 a transfer part that transfers onto a recording media P the toner image formed on the photoconductive drum 5, 10 a paper delivery part that delivers installed paper D to the paper read-in part 2, 12 through 14 paper feeding parts in which recording medias P of transfer paper or the like are stored, 20 a fixing device that fixes an unfixed image onto the recording media P, 21 a fixing film disposed in the fixing device 20 as a fixing member, and 31 a pressure roller disposed in the fixing device as a pressure member.

Operations of the image forming apparatus during normal image formation are described with reference to FIG. 1.

First, the paper D is delivered by a delivery roller towards an arrow direction inside the figure from a paper pedestal and passes above the paper read-in part 2. At this moment, image information of the paper D passing through above is read-in optically by the paper read-in part 2.

Then optical image information read-in by the paper read-in part is converted into electrical signals and sent to the exposure part (write part). Exposure light L of laser light or the like is projected onto the photoconductive drum 5 of the image forming part 4 based on image information of the electrical signals.

On the other hand, in the image forming part 4, the photoconductive drum 5 rotates in a clock-wise direction within the figure. An image (toner image) corresponding to image information is formed on the photoconductive drum 5 after predetermined image forming processes (charging process, exposure process and image development process).

The image formed on the photoconductive drum 5 is thereafter transferred onto the recording media P delivered by a resist roller in the transfer part 7.

On the other hand, the recording media P delivered to the transfer part 7 operates as follows.

First, one of the plurality of paper feeding parts 17, 13 and 14 of the image forming apparatus main body 1 is selected automatically or manually (for example, the uppermost paper feeding part 12 is selected).

Then an uppermost piece of the recording media P stored in the paper feeding part 12 is delivered towards the position of a delivery path K.

Thereafter, the recording media P passes through the delivery path K and reaches the position of the resist roller. The recording media P having reached the position of the resist roller is delivered towards the transfer part 7 in a matched timing for positional alignment with the image formed on the photoconductive drum 5.

After the transfer process, the recording media P passes through the position of the transfer part 7 and reaches the fixing device 20 via the delivery path. The recording media P having reached the fixing device is sent in between the fixing film 21 and the pressure roller 31. An image is fixed by the heat received from the fixing film 21 and the pressure received from both the fixing film 21 and the pressure roller 31. The recording media P with a fixed image is sent out from the nip part between the fixing film 21 and the pressure roller 31 to be ejected from the image forming apparatus main body 1.

The series of image forming processes are completed as such.

Next, constitutions and operations of the fixing device 20 disposed in the image forming apparatus main body 1 are described in detail with reference to FIG. 2 through FIG. 5.

Figure 2:
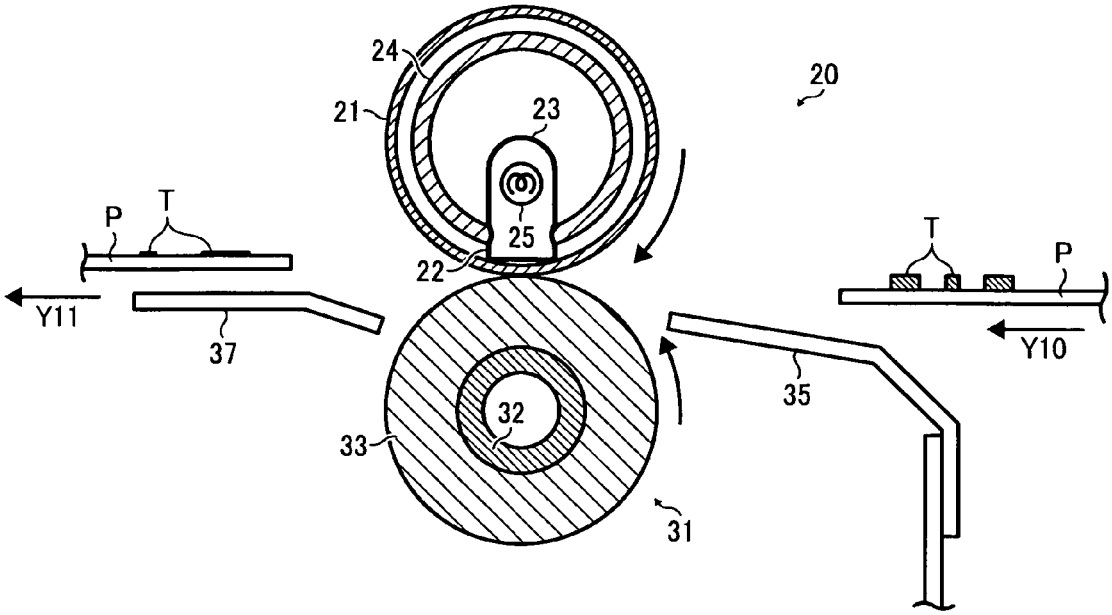
FIG. 2 is a constitutional diagram that illustrates a fixing device.
Figure 3:
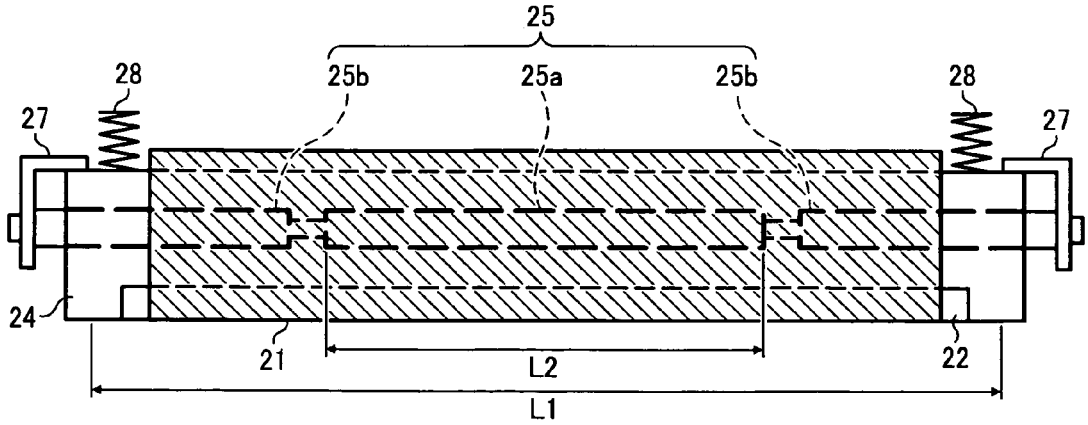
FIG. 3 is a diagram that illustrates parts of the fixing device viewed from a width direction.
Figure 4:
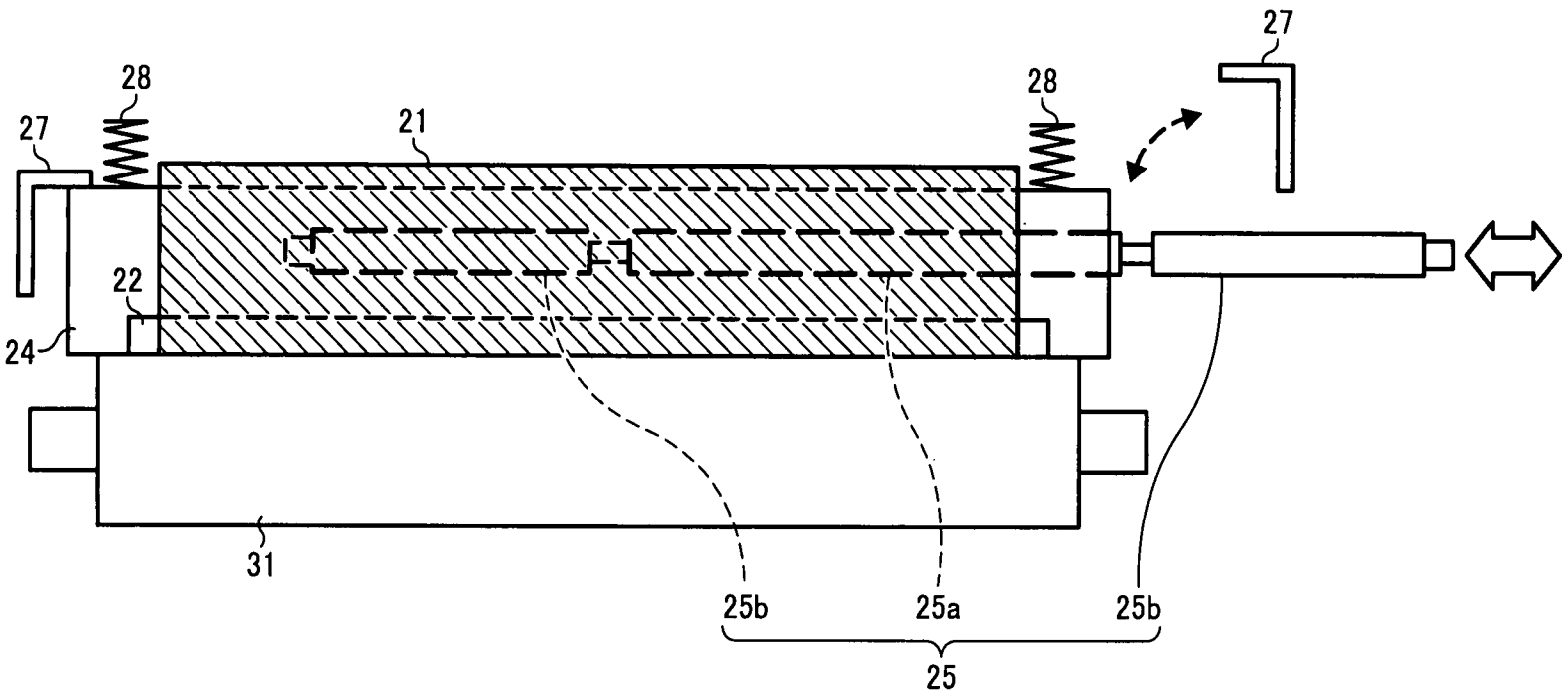
FIG. 4 is a diagram that illustrates a state in which a plurality of heating devices are inserted and detached.
Figure 5:
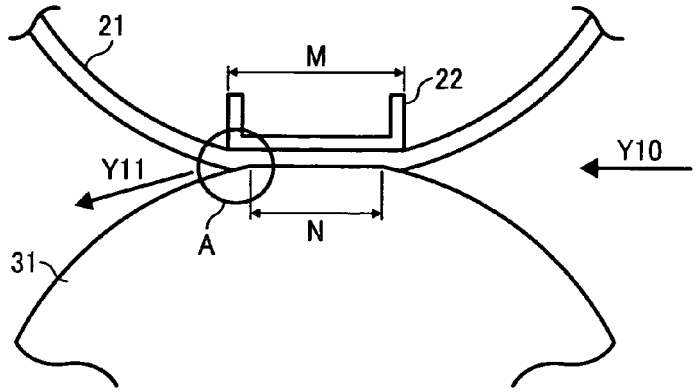
FIG. 5 is a partially enlarged diagram that illustrates the vicinity of a nip part of the fixing device.

FIG. 2 is a constitutional diagram that illustrates the fixing device 20. FIG. 3 is a diagram that illustrates parts of the fixing device 20 viewed from a width direction. FIG. 4 is a diagram that illustrates a state in which a group of heaters 25 as heating devices is inserted and detached from the fixing device 20. FIG. 5 is a partially enlarged diagram that illustrates the vicinity of a nip part of the fixing device 20.

As illustrated in FIG. 2, the fixing device 20 includes the fixing film 21 as the fixing member, a heating plate 22 as the contact member, a reflecting plate 23 as a reflective member, a holding member 24, the group of heaters 25 as heating devices, the pressure roller 31 as the pressure member, guide plate 35, 37 and so on. With reference to FIG. 3, the group of heaters 25 is constituted from a first infrared ray heater 25*a* (heating device) and a second infrared ray heater 25*b* (heating device).

Hereby the fixing film 21 as the fixing member is a thin-walled flexible endless film and rotates in an arrow direction (clock-wise direction) within the FIG. 2. Polyimide, polyamide, fluorine resin and metal or the like can be used as the material for the fixing film 21. In order to guarantee mold releasability (peel property) against a toner T (toner image), a mold release layer constituted from PFA (copolymer resin of tetrafluoroethylene-co-perfluoroalkylvinylether), polyimide, polyetherimide, PES (polyethersulphide) or the like can also be formed on a surface layer of the fixing film 21. By using the fixing film 21 with a low thermal capacity as the fixing member, an on-demand type fixing device with an extremely short rise time can be provided.

In the internal part (inner circumference surface side) of the fixing film 21, a group of heaters (a plurality of heating devices), the heating plate 22, the reflecting plate 23 and the holding member 24 are fixedly disposed. The fixing film 21 is pressed by the heating plate 22 and forms the nip part between itself and the pressure roller 31.

The heating plate 22 as the contact member is a metal plate of a plate thickness of about 0.1 mm (or plate material constituted from ceramic and polyimide resin). The heating plate 22 is heated by the group of heaters 25 by radiation heat and comes into contact with the pressure roller 31 via the fixing film 21 to form a desired nip part.

In addition, in the first embodiment, an opposed surface of the heating plate 22 facing the pressure roller 31 is configured to be a plane shape. Thereby the shape of the nip part is configured to be approximately parallel against an image surface of the recording media P so that fixative property is improved due to a heightened property of close contact between the fixing film 21 and the recording media P and flaws such as curls and wrinkles generated to the recording media P passing through the nip part are also reduced. Furthermore, curvature of the fixing film 21 in the exit side of the nip part becomes larger so that the recording media P sent out from the nip part can be easily separated from the fixing film 21.

In addition, in the first embodiment, the fixing film 21 is in sliding contact with a surface of the heating plate 22. The surface is coated with fluorine resin. The heating plate 22 is fixedly supported by the fixing device 20. Thereby wear of the inner circumference surface of the fixing film 21 in sliding contact with the heating plate 22 can be alleviated.

With reference to FIG. 3, the group of heaters 25 is constituted from an infrared ray heater 25*a* (heating device) disposed in a central portion of a width direction and a pair of infrared ray heater 25*b* (heating device) disposed in both ends of the width direction. The plurality of infrared ray heater 25*a*, 25*b* are carbon heaters and halogen heaters and disposed in line against the width direction. Both end parts of the group of heaters 25 are fixed to a side plate of the fixing device 20 via the holding member 24. Outputs of the infrared ray heater 25*a* and 25*b* are controlled by a power source part of the apparatus main body 1. The heating plate 22 is heated by the infrared ray heater 25*a* and 25*b*. The fixing film 21 is further heated by the heating plate 22. Heat is applied from the surface of the fixing film 21 to the toner image T on the recording media P. In addition, output controls of the infrared ray heater 25*a* and 25*b* are performed based on detection results of film surface temperatures. The detection results are obtained by a temperature sensor (not illustrated) facing the surface of the fixing film 21. In addition, the temperature (fixing temperature) of the fixing film 21 can be set to desired temperatures by such output controls of the infrared ray heater 25*a* and 25*b*.

Hereby the disposed infrared ray heater 25*a* and 25*b* (the plurality of heating devices) can be inserted and detached against the fixing device 20 in a state which the heating plate 22 comes into contact with the pressure roller 31 via the fixing film 21. This will be described later in detail in FIG. 4.

In the case carbon heaters are used as infrared ray heater 25*a* and 25*b*, in comparison to the case in which halogen heaters are used, the degree of freedom of on control and off control increase. Specifically, wire break does not occur even when an off control that turns off the current before duties of the heaters 25*a* and 25*b* reach 100% is repeated and output decreases with time are also alleviated.

In addition, in the case carbon heaters are used, the shape of the carbon heaters used is optimized. The carbon heaters used are preferably constituted so that heat quantity of the radiation heat generated in a direction facing the heating plate 22 (up-and-down direction of FIG. 2) is larger than heat quantity of the radiation heat generated in a direction (left-and-right direction of FIG. 2) orthogonal to the direction facing the heating plate 22. Thereby the heat generated from the heaters 25*a* and 25*b* can be directed in concentration to the heating plate 22 so that heating efficiency of the heating plate 22 is heightened.

The reflecting plate 23 is disposed in one side opposite to a side facing the heating plate 22 against the infrared ray heater 25*a* and 25*b* (upside of the infrared ray heater 25*a* and 25*b* in FIG. 2). The reflecting plate 23 applies mirror surface finishing to aluminum and reflects infrared rays emitted from the infrared ray heater. Most of the infrared rays reflected by the reflecting plate 23 enter the heating plate 22 so that heating efficiency of the heating plate 22 is heightened.

In the first embodiment, the reflecting plate 23 is disposed in a position separated from the infrared ray heater 25*a* and 25*b* but a portion of glass tubes of the infrared ray heater 25*a* and 25*b* (situated in the one side opposite to the side facing the heating plate 22) can be applied gold coating and evaporated aluminum. Heating efficiency of the heating plate 22 is also heightened in this case because the gold coating and the evaporated aluminum applied to the glass function as the reflective member.

In addition, an absorbent material that absorbs infrared ray can be disposed in the opposed surface of the heating plate 22 (a side facing the infrared ray heater 25*a* and 25*b*). Specifically, the opposed surface of the heating plate 22 can be applied black paint. Thereby absorbent ratio of infrared ray in the heating plate 22 is improved so that heating efficiency of, the heating plate 22 is heightened.

With reference to FIG. 3, the holding member 24 holds in integration the heating plate 22, the group of heaters 25 and the reflecting plate 23. The holding member 24 is constituted from a heat resistant resin material. Both ends of the holding member 24 are respectively supported by a side plate of the fixing device 20.

Especially, the group of heaters 25 is held in the holding member 24 via holder 27 as the second holding member. Specifically, the holder 27 is screw fastened respectively at both ends in the width direction of the holding member 24. An engaging hole that engages with an end part of the group of heaters 25 is disposed in the holder 27. Then by taking out the holder 27 from the holding member 24, only the group of heaters 25 (the plurality of infrared ray heater 25*a*, 25*b*) can be detached from the holding member 24 (fixing device 20).

In addition, a compression spring 28 is disposed respectively at both ends in the width direction of the holding member 24 so that the heating plate 22 as the contact member is urged towards the pressure roller 31 and forms the desired nip part. The pressure roller 31 is disposed in a side plate (fixed position) of the fixing device 20 to be freely rotatable via a bearing. The pressure roller 31 is rotated and driven in a predetermined direction by a not illustrated drive motor. The fixing film 21 is driven in an arrow direction of FIG. 2 by the frictional force between the fixing film 21 and the pressure roller 31.

By the above described constitution, the drive mechanism and the pressure mechanism in the fixing device 20 can be simplified.

Furthermore, with reference to FIG. 2, the holding member 24 is formed to guide the fixing film 21. That is to say, the holding member 24 is formed to a round shape so that the round posture of the flexible fixing film 21 can be maintained to a certain extent. Thereby deteriorations and damages due to shape changes of the fixing film 21 can be alleviated.

With reference to FIG. 2, the pressure roller 31 as the pressure member forms an elastic layer 33 on a cored bar 32. The elastic layer 33 of the pressure roller 31 is formed from materials of fluorine-contained rubber, silicone rubber and foamable silicone rubber or the like. In addition, a thin-walled mold release layer (tube) of PFA or the like can be disposed on the surface layer of the elastic layer 33. The pressure roller 31 is pressure-welded to the fixing film 21 and forms the desired nip part between both members. In addition, the pressure roller 31 is rotated and driven in an arrow direction (counter-clockwise direction) within the FIG. 2 by a not illustrated drive mechanism.

The recording media P is delivered towards the nip part. The guide plate 35 (entry guide plate) that guides the recording media P is disposed in the entry side of the part in contact (nip part) between the fixing film 21 and the pressure roller 31. In addition, in the exit side of the nip part, the guide plate 37 (exit guide plate) that guides the recording media P sent out from the nip part is disposed. Guide plate 35 and 37 are both fixedly disposed in a frame (chassis) of the fixing device 20.

The fixing device 20 constituted as described above is operated as follows.

When the power switch of the apparatus main body 1 is inputted, electrical power is supplied to the infrared ray heater 25*a* and 25*b*. The pressure roller 31 begins to be rotated and driven in the arrow direction within the FIG. 2. Thereby the fixing film 21 is also driven (rotated) in the arrow direction with the FIG. 2 due to the frictional force between the fixing film 21 and the pressure roller 31.

Thereafter the recording media P is fed from paper feeding part 12 through 14, an unfixed image is carried on the recording media P in the image forming part 4. The recording media P carried on with the unfixed image T (toner image) is guided by the guide plate 35 to be delivered in a direction of an arrow Y10 of FIG. 2 and sent into the nip part between the fixing film 21 and the pressure roller 31 in a pressure-welded state.

The fixing film 21 is heated by the heating plate 22. Then the toner image T is fixed on the surface of the recording media P due to heating by the fixing film 21 and the pressing force of the heating plate 22 (fixing film 21) and the pressure roller 31. Thereafter the recording media P sent out from the nip part is delivered in a direction of an arrow Y11.

In the first embodiment, the group of heaters 25 (the plurality of infrared ray heater 25*a* and 25*b*) is constituted so that in correspondence to the size in the width direction of the recording media P delivered to the nip part, heating area of the width direction against the heating plate 22 is variable.

Specifically, with reference to FIG. 3, when the recording media P of a maximum paper width L1 (a recording media of the maximum size for possible through feed in the image forming apparatus 1 of the first embodiment, for example, a recording media of A4 size) is fed through, electrical power is supplied to all infrared ray heaters 25*a* and 25*b* and the entire area of the width direction (the L1 area) of the heating plate 22 is heated uniformly. In contrast, when the recording media P of an L2 size, that is, a size smaller than the maximum paper width L1 (for example, a recording media of A5 size) is fed through, electrical power is supplied only to the infrared ray heater 25*a* situated at the central portion and only the central portion of the width direction (the L2 area) of the heating plate 22 is heated. Thereby such flaw as excessive temperature rises at the both end parts (non-through feed area) of the fixing film 21 generated when the entire area of the width direction of the heating plate 22 is heated but small sized paper with a small size in the width direction is consecutively fed through can be suppressed for certain.

In addition, the switch-over of heating areas of the above described group of heaters 25 is performed based on detected information of the size of the recording media. The detection of the size of the recording media can be performed based on input information of an operating portion of the apparatus main body 1 or based on information of a size detection sensor disposed in the paper feeding part.

In addition, in the first embodiment, in order to correspond to the recording media P of the maximum paper width L1 and the recording media P of the comparatively smaller paper width L2, the infrared ray heaters 25*b* disposed in both ends of the first infrared ray heater 25*a* are limited to only a pair. In contrast, in order to correspond to small sized paper of a plurality of kinds, a plurality of pairs of the infrared ray heaters 25*b* can be disposed in both ends of the first infrared ray heater 25*a*.

Furthermore, in the first embodiment, in correspondence to the size in the width direction of the recording media P, switch-over of a plurality of infrared ray heaters 25*a* and 25*b* is performed and the heating area of the width direction against the heating plate 22 is constituted to be variable. In contrast, in correspondence to an image range in the width direction of the recording media P, switch-over of a plurality of infrared ray heaters can be performed and the heating area of the width direction against the heating plate 22 can be constituted to be variable. For example, even in the case the recording media P of the maximum paper width L1 is fed through, when the image range in the width direction of the recording media P is situated only at the central portion (the L2 area), image information thereof is obtained from the exposure part 3 or the like, electrical power is supplied only to the first infrared ray heater 25*a* based on the image information and only the central portion of the width direction (the L2 area) of the heating plate 22 is heated. Thereby the flaw of excessive temperature rises at the both end parts (non image area) of the fixing film 21 is suppressed and heating efficiency of the group of heaters 25 is heightened.

Characteristic constitutions and operations in the fixing device 20 of the first embodiment are described in detail hereinafter with reference to FIG. 4.

In the first embodiment, the heating plate 22 comes into contact with the pressure roller 31 via the fixing film 21. In such a state, a constitution is adopted in which pressure releases of these members 21, 22 and 31 are not performed but the group of heaters 25 (the plurality of infrared ray heater 25*a* and 25*b*) is inserted against the fixing device 20 in such a manner as to be freely removable. Specifically, the holder 27 (the second holding member) against the holding member 24 can be attached and removed at will and the infrared ray heater 25*a* and 25*b* can be inserted and detached against the fixing device 20.

More specifically, in the case the group of heaters 25 needs to be taken out from the fixing device 20 for maintenance, first, the fastened screws are released and the holder 27 of one side is taken out from the holding member 24 (a movement in a direction of two arrows connected by a dotted line of FIG. 4). Thereafter, the group of heaters 25 is pulled out from the side of the taken out holder 27 (a movement in a white arrow direction of FIG. 4, that is, a movement towards the right side of FIG. 4). In the case all-new group of heaters 25 (or the group of heaters 25 after repair) need to be mounted to the fixing device 20, reverse operations to the above described pull out operations are performed.

As described above, the fixing device 20 in the first embodiment is constituted to have an extremely high rise time. Replacement and maintenance properties of the plurality of infrared ray heaters 25*a* and 25*b* with a relatively high frequency of replacement can be improved using a relatively simple constitution without disposing a mechanism that releases pressure between the heating plate 22 (fixing film 21) and the pressure roller 31.

In addition, in the first embodiment, with reference to FIG. 2, the infrared ray heater 25*a* and 25*b* as the heating devices are disposed separated against the heating plate 22 (contact member). That is, the infrared ray heater 25*a* and 25*b* are disposed leaving a certain gap from the heating plate 22. Thereby even in the case the fixing device 20 is transported or the like under a state in which the heating plate 22 is pressure-welded to the pressure roller 31 via the fixing film 21, vibrations received directly from the heating plate 22 or the like by the infrared ray heater 25*a* and 25*b* can be alleviated and damages to the infrared ray heater 25*a* and 25*b* can be suppressed. Furthermore, even in the case the recording media P jammed at the position of the fixing device 20 is taken out (performed jam processing) or the like under a state in which the heating plate 22 is pressure-welded to the pressure roller 31 via the fixing film 21, impacts received directly from the nip part 22 by the infrared ray heater 25*a* and 25*b* can be alleviated by the jam processing operations and damages to the infrared ray heater 25*a* and 25*b* can be suppressed.

In addition, in the first embodiment, with reference to FIG. 5, a length M of the delivery direction of the recording media of the heating plate 22 (contact member) is set to be longer than a nip quantity N of the nip part (M>N).

Thereby in the exit side (area A in the FIG. 5) of the nip part, the fixing film 21 is distorted to protrude towards the side of the pressure roller 31 according to the shape of the pressure roller 31. Therefore, the recording media P is sent out in a direction to be separated from the fixing film 21 (the direction of an arrow Y11 of FIG. 5) after the fixing process. That is, property to separate delivery when the recording media P is sent out from the nip part can be heightened.

As described above, in the first embodiment, the heating plate 22 (contact member) is heated by the group of heaters 25 (the plurality of heating devices) and forms the nip part. The group of heaters 25 is inserted against the fixing device 20 in such a manner as to be freely removable under a state in which the heating plate 22 comes into contact with the pressure roller 31 (pressure member) via the fixing film 21 (fixing member). The fixing device 20 with short rise time, a relatively simple constitution is provided under such a constitution and the group of heaters 25 has high replacement property in which fixture irregularity and partial excessive temperature rise of the fixing film 21 are not generated.

In the first embodiment, the present invention is applied to the fixing device using the pressure roller as the pressure member but the present invention can also be applied to a fixing device using a pressure belt or a pressure pad as the pressure member. Same effects as the first embodiment can also be obtained in that case.

In addition, in the first embodiment, the present invention is applied to the fixing device disposed in the monochrome image forming apparatus 1 but the present invention can certainly be also applied to a fixing device disposed in a color image forming apparatus. Same effects as the first embodiment can also be obtained in that case.

Embodiment 2

Figure 6:
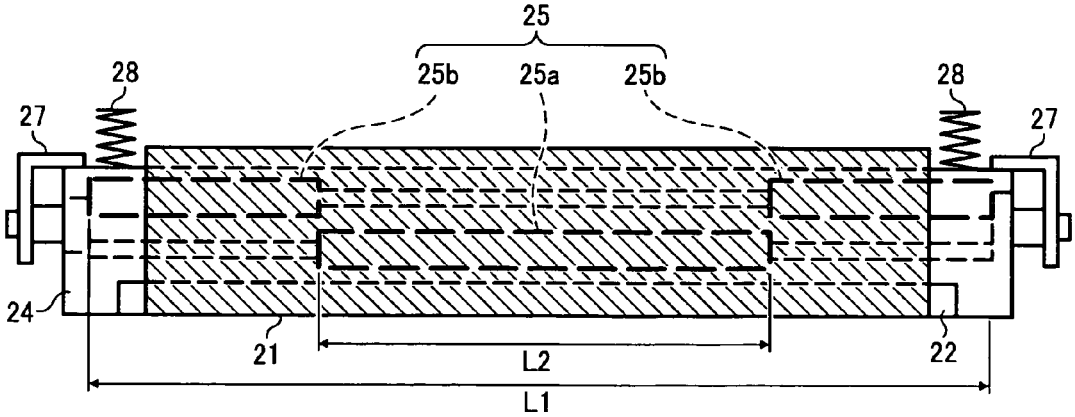
FIG. 6 is a diagram that illustrates parts of a fixing device viewed from a width direction according to a second embodiment of the present invention.

A second embodiment of the present invention is described in detail in FIG. 6.

FIG. 6 is a diagram that illustrates parts of a fixing device viewed from a width direction according to the second embodiment. FIG. 6 corresponds to FIG. 3 in the first embodiment. In the fixing device of the second embodiment, a plurality of heating devices 25*a* and 25*b* are disposed parallel against the width direction and differ from the first embodiment in which the plurality of heating devices 25*a* and 25*b* are disposed in line against the width direction.

With reference to FIG. 6, the same as the fixing device 20 in the first embodiment, the fixing device 20 in the second embodiment is also constituted from the fixing film 21, the heating plate 22, the holding member 24, the group of heaters 25, the pressure roller 31 or the like. In addition, the group of heaters 25 is constituted from the first infrared ray heater 25*a* (heating device) disposed in the central portion of the width direction and the pair of infrared ray heaters 25*b* (heating devices) disposed in the both ends of the width direction.

In addition, also in the second embodiment, when the recording media P of the maximum paper width L1 is fed through, electrical power is supplied to all infrared ray heaters 25*a* and 25*b* and the entire area of the width direction (the L1 area) of the heating plate 22 is heated uniformly. In contrast, when the recording media P of the L2 size, that is, a size smaller than the maximum paper width L1 is fed through, electrical power is supplied only to the infrared ray heater 25*a* situated at the central portion and only the central portion of the width direction (the L2 area) of the heating plate 22 is heated.

In the second embodiment, the plurality of infrared ray heater 25*a* and 25*b* are disposed parallel against the width direction.

In addition, the same as the fixing device 20 in the first embodiment, also in the fixing device 20 of the second embodiment, the heating plate 22 comes into contact with the pressure roller 31 via the fixing film 21. In such a state, a constitution is adopted in which pressure releases of these members 21, 22 and 31 are not performed but the group of heaters 25 (the plurality of infrared ray heater 25*a* and 25*b*) is inserted against the fixing device 20 in such a manner as to be freely removable. Specifically, the holder 27 (the second holding member) against the holding member 24 can be attached and removed at will and the group of heaters 25 can be inserted and detached against the fixing device 20.

As described above, the same as the first embodiment, also in the second embodiment, the heating plate 22 (contact member) is heated by the group of heaters 25 (the plurality of heating devices) and forms the nip part. The group of heaters 25 is inserted against the fixing device 20 in such a manner as to be freely removable under a state in which the hearting plate 22 comes into contact with the pressure roller 31 (pressure member) via the fixing film 21 (fixing member). The fixing device 20 with short rise time, a relatively simple constitution is provided under such a constitution and the group of heaters 25 has high replacement property in which fixture irregularity and partial excessive temperature rise of the fixing film 21 are not generated.

Embodiment 3

Figure 7:
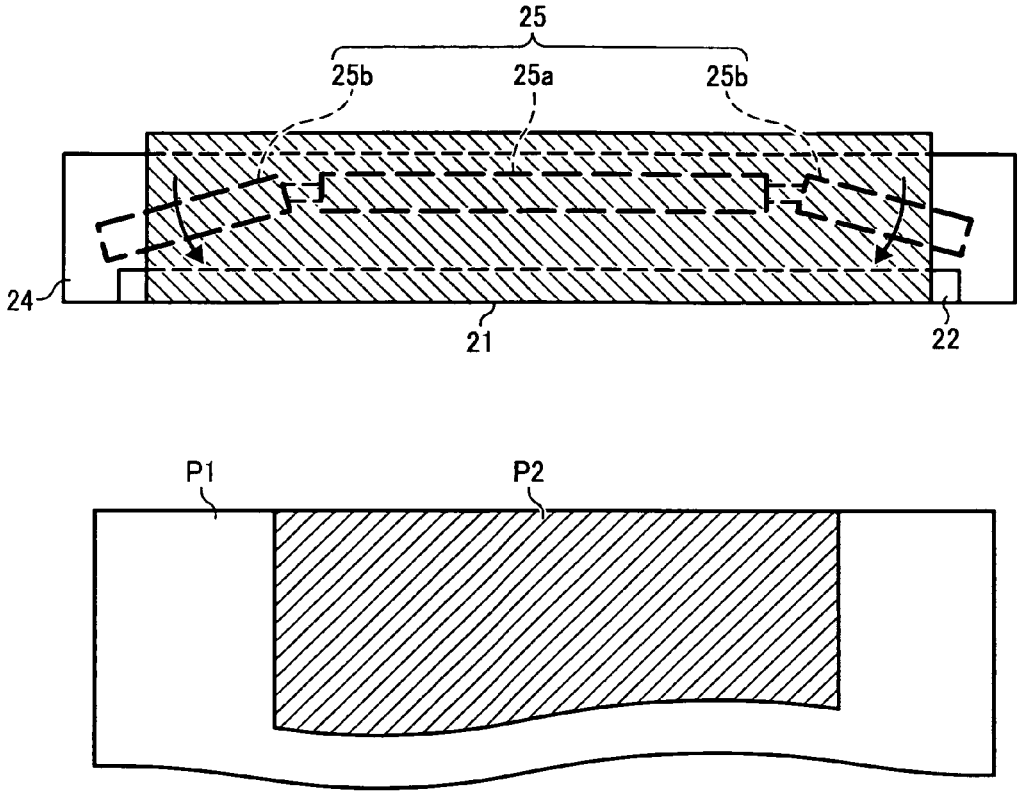
FIG. 7 is a diagram that illustrates parts of a fixing device viewed from a width direction according to a third embodiment of the present invention.

A third embodiment of the present invention is described in detail with reference to FIG. 7. FIG. 7 is a diagram that illustrates parts of a fixing device viewed from a width direction according to the third embodiment. FIG. 7 corresponds to FIG. 3 in the first embodiment. The fixing device in the third embodiment differs from the fixing device in the first embodiment in that angles of the pair of heating devices 25*b* facing the contact member 22 are constituted to be variable.

With reference to FIG. 7, the same as the fixing device 20 in the first embodiment, the fixing device 20 in the third embodiment is also constituted from the fixing film 21, the heating plate 22, the holding member 24, the group of heaters 25, the pressure roller 31 or the like. In addition, the group of heaters 25 is constituted from the first infrared ray heater 25*a* (heating device) disposed in the central portion of the width direction and the pair of infrared ray heaters 25*b* (heating devices) disposed in the both ends of the width direction. The infrared ray heaters 25*a* and 25*b* are disposed in line against the width direction.

In addition, the same as the fixing device 20 in the first embodiment, also in the fixing device 20 of the third embodiment, the heating plate 22 comes into contact with the pressure roller 31 via the fixing film 21. In such a state, a constitution is adopted in which pressure releases of these members 21, 22 and 31 are not performed but the group of heaters 25 (the plurality of infrared ray heater 25*a* and 25*b*) is inserted against the fixing device 20 in such a manner as to be freely removable. Specifically, the holder 27 (the second holding member) against the holding member 24 can be attached and removed at will and the group of heaters 25 can be inserted and detached against the fixing device 20.

In the third embodiment, the pair of infrared ray heaters 25*b* are disposed in the both end parts of the width direction. Angles of the pair of infrared ray heaters 25*b* facing the heating plate 22 (gradient angles against the width direction) are constituted to be variable by a not illustrated variable device. Based on the width direction size (or image area) of the recording media P delivered to the nip part, angles of the second infrared ray heater 25*b* are variably controlled.

Specifically, when the recording media P1 of the maximum paper width L1 is fed through, the second infrared ray heater 25*b* is controlled to face head-on against the heating plate 22. Electrical power is supplied to all infrared ray heaters 25*a* and 25*b* and the entire area of the width direction (the L1 area) of the heating plate 22 is heated uniformly.

In contrast, when the recording media P2 of the L2 size, that is, a size smaller than the maximum paper width L1 is fed through, the second infrared ray heater 25*b* is controlled to incline against the heating plate 22 (the state of FIG. 7). Electrical power is supplied to all infrared ray heaters 25*a* and 25*b*. At this moment, because the second infrared ray heater 25*b* is inclined towards the central portion of the width direction so that the direction of heat radiation faces towards the central portion of the width direction and the central portion of the width direction (the L2 area) of the heating plate 22 is heated in concentration. Thereby excessive temperature rises at both end parts of the fixing film 21 generated when small sized paper P2 is consecutively fed through can be suppressed.

Figure 9:
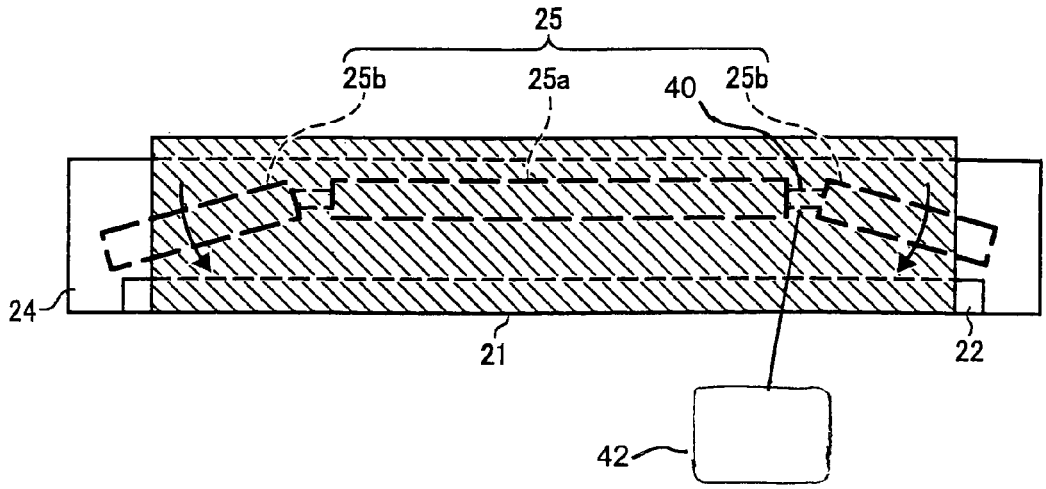
FIG. 9 is a diagram that illustrates parts of the fixing device viewed from a width direction.

In addition, as shown in FIG. 9, the variable device 40 that variably changes the angles of the second infrared ray heater 25*b* is disposed in one end of (an end part of the side of the first infrared ray heater 25*a*) the infrared ray heater 25*b*. The variable device can be constituted from a support member that supports the second infrared ray heater 25*b* so that the second infrared ray heater is freely rotatable, a cam that engages with the other end of the infrared ray heater 25*b*, a drive motor 42 that rotates the cam for a predetermined angle or the like.

As described above, the same to the previous embodiments, also in the third embodiment, the heating plate 22 (contact member) is heated by the group of heaters 25 (the plurality of heating devices) and forms the nip part. The group of heaters 25 is inserted against the fixing device 20 in such a manner as to be freely removable under a state in which the hearting plate 22 comes into contact with the pressure roller 31 (pressure member) via the fixing film 21 (fixing member). The fixing device 20 with short rise time, a relatively simple constitution is provided under such a constitution and the group of heaters 25 has high replacement property in which fixture irregularity and partial excessive temperature rise of the fixing film 21 are not generated.

Embodiment 4

Figure 8:
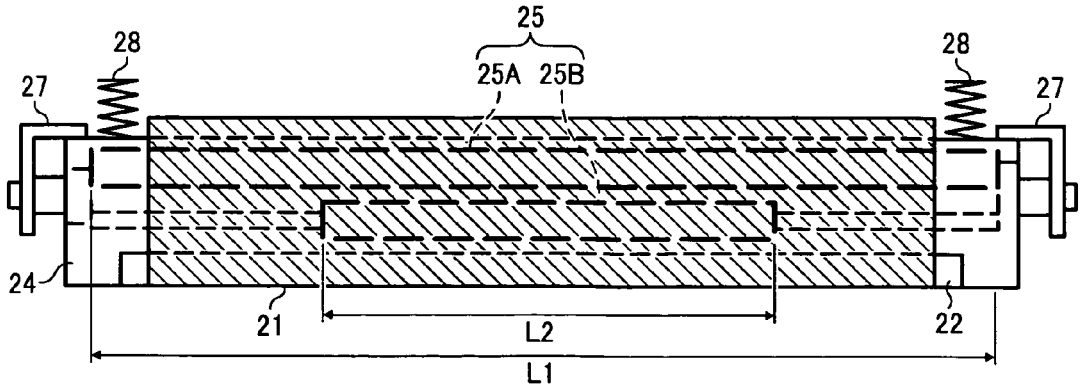
FIG. 8 is a diagram that illustrates parts of a fixing device viewed from a width direction according to a fourth embodiment of the present invention.

A fourth embodiment of the present invention is described in detail in FIG. 8. FIG. 8 is a diagram that illustrates parts of a fixing device viewed from a width direction according to the fourth embodiment. FIG. 8 corresponds to FIG. 3 in the first embodiment. The fixing device in the fourth embodiment differs from the fixing device in the first embodiment in that heating devices 25A and 25B with differing lengths in the width direction are disposed parallel against the width direction.

With reference to FIG. 8, the same as the fixing device 20 in the previous embodiments, the fixing device 20 in the fourth embodiment is also constituted from the fixing film 21, the heating plate 22, the holding member 24, the group of heaters 25 (the plurality of heating devices), the pressure roller 31 or the like.

In the fourth embodiment, the group of heaters 25 is constituted from two infrared ray heaters 25A and 25B with differing lengths in the width direction and disposed parallel against the width direction. Specifically, the length in the width direction of the first infrared ray heater 25A is set to L1. In contrast, the length in the width direction of the second infrared ray heater 25B is set to L2.

Then when the recording media P of the maximum paper width L1 is fed through, electrical power is supplied to only the first infrared ray heater 25A and the entire area of the width direction (the L1 area) of the heating plate 22 is heated uniformly. In contrast, when the recording media P of the L2 size, that is, a size smaller than the maximum paper width L1 is fed through, electrical power is supplied to only the second infrared ray heater 25B and only the central portion of the width direction (the L2 area) of the heating plate 22 is heated.

In addition, the same as the fixing device 20 in the previous embodiments, also in the fixing device 20 of the fourth embodiment, the heating plate 22 comes into contact with the pressure roller 31 via the fixing film 21. In such a state, a constitution is adopted in which pressure releases of these members 21, 22 and 31 are not performed but the group of heaters 25 (the plurality of infrared ray heater 25A and 25B) is inserted against the fixing device 20 in such a manner as to be freely removable. Specifically, the holder 27 (the second holding member) against the holding member 24 can be attached and removed at will and the group of heaters 25 can be inserted and detached against the fixing device 20.

As described above, the same to the previous embodiments, also in the fourth embodiment, the heating plate 22 (contact member) is heated by the group of heaters 25 (the plurality of heating devices) and forms the nip part. The group of heaters 25 is inserted against the fixing device 20 in such a manner as to be freely removable under a state in which the hearting plate 22 comes into contact with the pressure roller 31 (pressure member) via the fixing film 21 (fixing member). The fixing device 20 with short rise time, a relatively simple constitution is provided under such a constitution and the group of heaters 25 has high replacement property in which fixture irregularity and partial excessive temperature rise of the fixing film 21 are not generated.

In the present invention, the plurality of heating devices are constituted to be inserted against the fixing device in such a manner as to be freely removable under a state in which the contact member is heated by the plurality of heating devices to form the nip part and comes into contact with the pressure member via the fixing member so that the fixing device and an image forming apparatus with short rise time, a relatively simple constitution can be provided in which the plurality of heating devices have high replacement property and fixture irregularity or partial excessive temperature rise of the fixing member are not generated.

The present invention is not limited to each of the previous embodiments. Each of the above described embodiments can be modified accordingly. In addition, numbers, positions and shapes of the constitutional members described in the above embodiments can be preferably set.

What is claimed is:

1. A fixing device, comprising:

a flexible fixing member that heats a toner image for fusion;

a holding member within the flexible fixing member that maintains a shape of the flexible fixing member;

a contact member fixedly disposed inside the fixing member and configured to come into contact with a pressure member via the fixing member to form a nip part;

a heating device that heats the contact member; and a removable holder, the heating device being held within the fixing device by the removable holder, wherein the heating device is fixed within the fixing device via the holding member, the contact member always maintains a contact state with the pressure member via the fixing member, and the heating device is disposed within the contact member.

2. The fixing device according to claim 1, wherein the heating device includes a plurality of heating devices and has a variable heating area of the width direction against the contact member in correspondence to an image area or a size of the width direction of a recording media delivered to the nip part.

3. The fixing device according to claim 2, wherein:

the plurality of heating devices comprise a central heating device and at least one pair of heating devices disposed at both ends of the central heating device, the central heating device and the at least one pair of heating devices at the opposite end of the central heating device are disposed in a straight line along a width direction of the plurality of heating devices.

4. The fixing device according to claim 3, further comprising:

a variable device between two of the plurality of heating devices, the variable device including a support member and a cam and changes variably angles of the pair of heating devices facing the contact member.

5. The fixing device according to claim 4, wherein the variable device changes variably angles of the pair of heating devices facing the contact member in correspondence to an image area or a size of the width direction of a recording media delivered to the nip part.

6. The fixing device according to claim 2, wherein:

the plurality of heating devices comprise a central heating device and at least one pair of heating devices disposed at both ends of the central heating device, the central heating device and the at least one pair of heating devices at the opposite end of the central heating device are disposed mutually parallel and parallel to the width direction.

7. The fixing device according to claim 6, further comprising:

a variable device between two of the plurality of heating devices, the variable device including a support member and a cam and changes variably angles of the pair of heating devices facing the contact member.

8. The fixing device according to claim 2, wherein the plurality of heating devices have differing lengths in the width direction and are disposed mutually parallel and parallel to the width direction.

9. The fixing device according to claim 1, wherein the heating device is an infrared ray heater.

10. The fixing device according to claim 1, wherein the fixing member is a fixing film.

11. The fixing device according to claim 1, wherein the pressure member is disposed in a fixed position of the fixing device to be freely rotatable, the contact member is pressed towards the pressure member.

12. An image forming apparatus, comprising:

the fixing device according to claim 1.

13. The fixing device according to claim 1, wherein the contact member has a length in a recording media receiving direction longer than a length of the nip part.

14. The fixing device according to claim 11, wherein the fixing film is distorted toward the pressure member on an exit side of the nip part.

15. The fixing device according to claim 1, wherein the contact member includes a reflecting plate contiguously attached thereto.

16. The fixing device of claim 15, wherein the holding member holds in integration the contact member, the heating device and the reflecting plate.

17. The fixing device according to claim 1, further comprising at least one compression spring that urges the contact member towards the pressure roller.

* * * * *